US009964295B1

(12) United States Patent
Fang et al.

(10) Patent No.: US 9,964,295 B1
(45) Date of Patent: May 8, 2018

(54) BUILDING BLOCK LIGHT MODULE

(71) Applicant: UBTECH Robotics Corp., Shenzhen (CN)

(72) Inventors: Xiongyuan Fang, Shenzhen (CN); Youjun Xiong, Shenzhen (CN)

(73) Assignee: UBTECH ROBOTICS CORP., Shenzhen (CN)

( * ) Notice: Subject to any disclaimer, the term of this patent is extended or adjusted under 35 U.S.C. 154(b) by 0 days. days.

(21) Appl. No.: 15/495,979

(22) Filed: Apr. 25, 2017

(30) Foreign Application Priority Data

Dec. 31, 2016 (CN) ..... 2016 1 1264332

(51) Int. Cl.

| | |
|---|---|
| ***F21V 17/06*** | (2006.01) |
| ***F21V 23/00*** | (2015.01) |
| ***F21V 3/02*** | (2006.01) |
| *F21Y 113/13* | (2016.01) |
| *F21Y 115/10* | (2016.01) |

(52) U.S. Cl.
CPC ..... *F21V 23/005* (2013.01); *F21V 3/02* (2013.01); *F21V 17/06* (2013.01); *F21Y 2113/13* (2016.08); *F21Y 2115/10* (2016.08)

(58) Field of Classification Search
CPC ..... F21V 23/005; F21V 17/06; F21V 3/02
See application file for complete search history.

(56) References Cited

U.S. PATENT DOCUMENTS

| | | | | |
|---|---|---|---|---|
| 9,410,676 | B1 * | 8/2016 | Vidal | F21V 13/04 |
| 9,683,708 | B2 * | 6/2017 | Vidal | F21K 9/237 |
| 2013/0242615 | A1 * | 9/2013 | Lin | A63H 33/042 362/640 |

* cited by examiner

*Primary Examiner* — Thomas M Sember

(57) ABSTRACT

A building block light module includes: an upper portion defining a receiving chamber with opposite open ends; a shield including a plurality of light transmissive surfaces; a circuit board including a plurality of light sources corresponding to the light transmissive surfaces, and a lower portion defining a plurality of connection holes for mating with building blocks. The lower portion and the shield are respectively mounted at the open ends of the receiving chamber.

11 Claims, 7 Drawing Sheets

BUILDING BLOCK LIGHT MODULE

CROSS REFERENCE TO RELATED APPLICATIONS

This application claims priority to Chinese Patent Application No. 201611264332.6, filed Dec. 31, 2016, which is hereby incorporated by reference herein as if set forth in its entirety.

BACKGROUND

1. Technical Field

The present disclosure generally relates to the field of lighting, and particularly to a building block light module.

2. Description of Related Art

With the development of technology, building block robots have been widely found in people's lives. Some conventional building block robots comprise various modules, such as main controllers, servos, connectors, decorative members and light modules, to build a variety of different figures. The robots controlled by the servos can perform a variety of actions.

However, the conventional building block light modules have limited functions, and cannot adapt to various modules, which cannot achieve a better user experience.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

Figure 1:
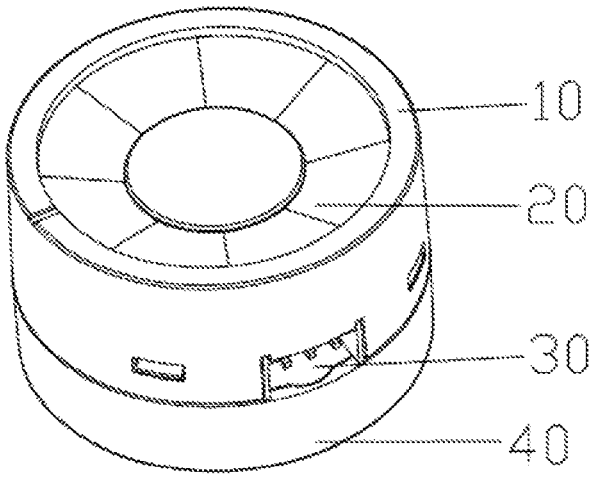
FIG. 1 is an isometric view of a building block light module according to an embodiment.

The disclosure is illustrated by way of example and not by way of limitation in the figures of the accompanying drawings, in which like reference numerals indicate similar elements. It should be noted that references to "an" or "one" embodiment in this disclosure are not necessarily to the same embodiment, and such references can mean "at least one" embodiment.

Figure 2:
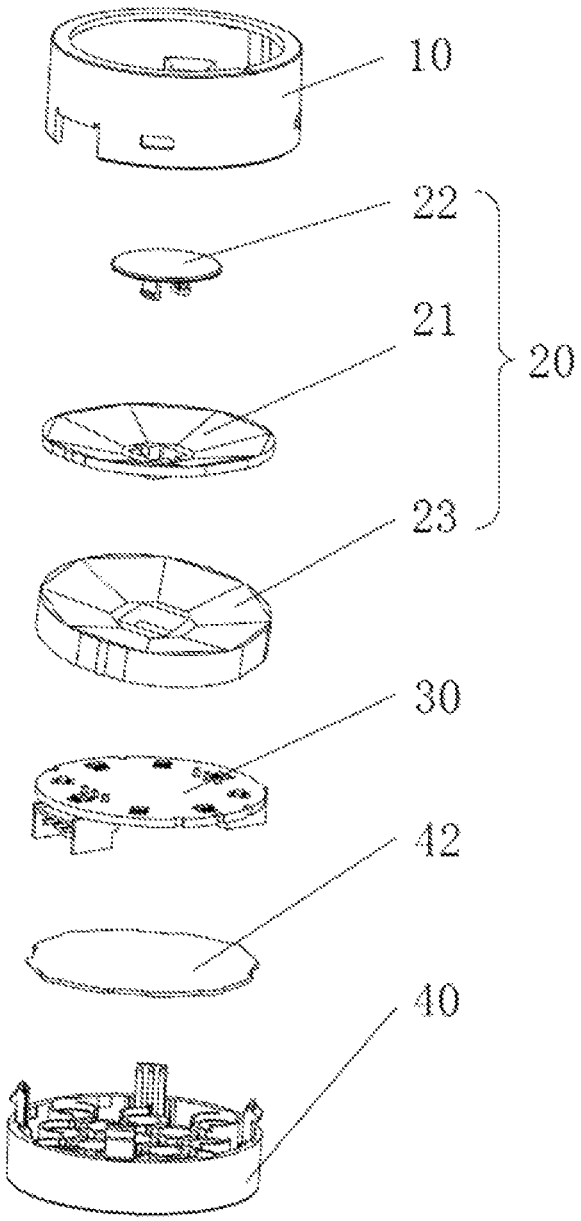
FIG. 2 is an exploded isometric view of a building block light module according to an embodiment.
Figure 3:
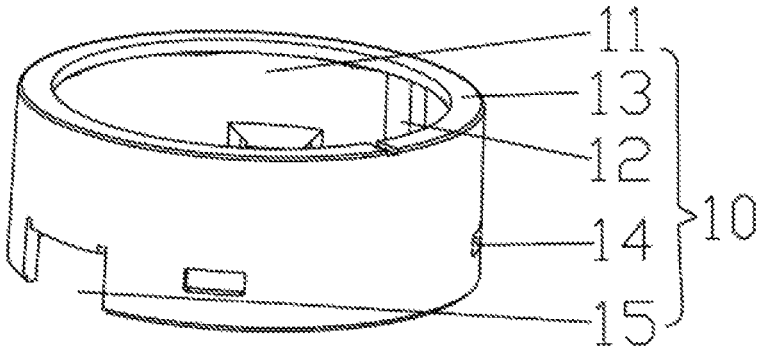
FIG. 3 is an isometric view of an upper portion according to an embodiment.
Figure 4:
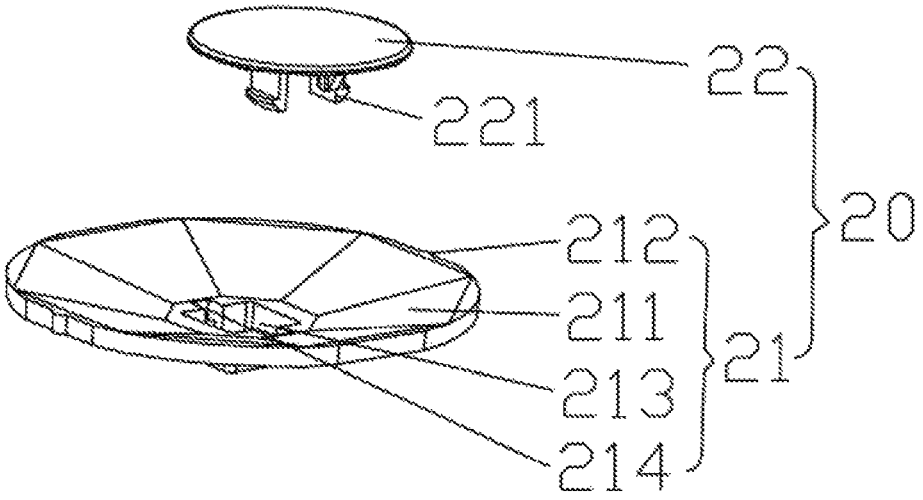
FIG. 4 is an isometric view of a shield according to an embodiment.
Figure 5:
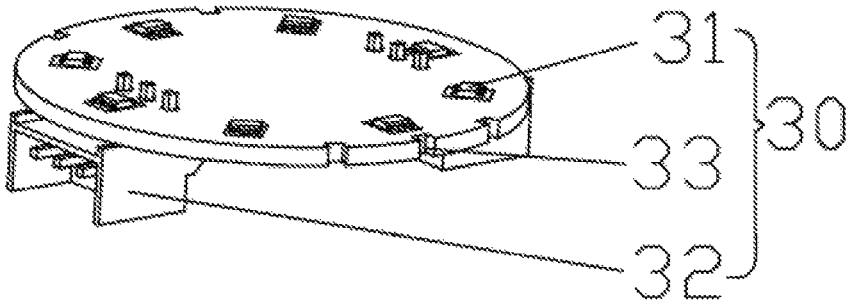
FIG. 5 is an isometric view of a circuit board according to an embodiment.
Figure 6:
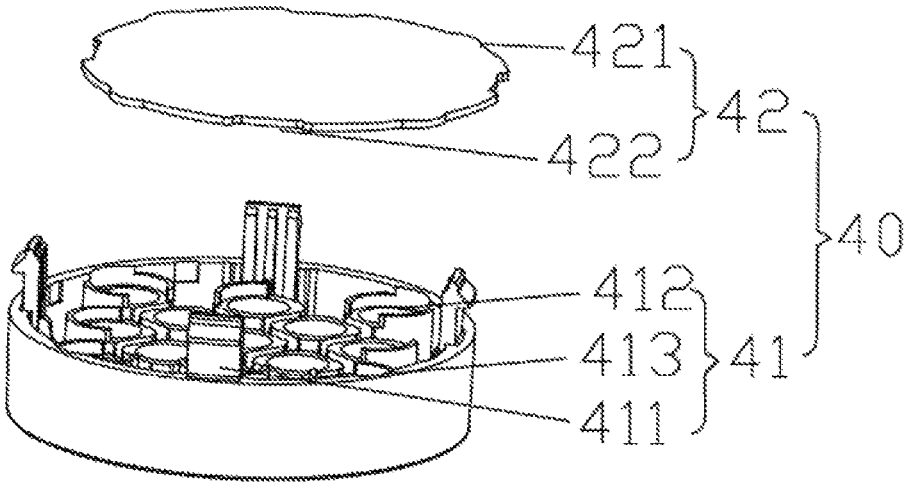
FIG. 6 is an isometric view of a lower portion according to one embodiment.
Figure 7:
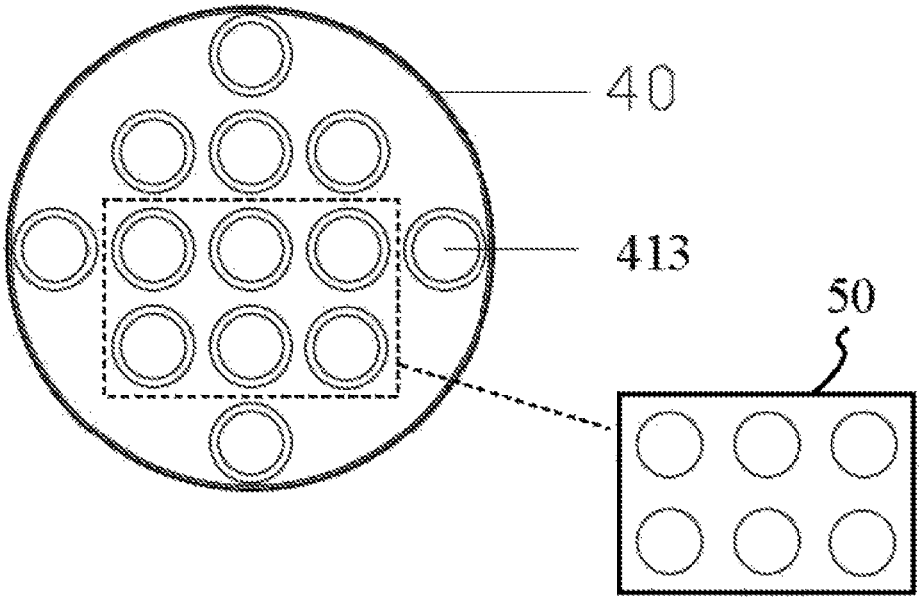
FIG. 7 is a bottom view of the building block light module according to an embodiment.

Referring to FIGS. 1-7, in one embodiment, a building block light module includes an upper portion 10, a shield 20, a circuit board 30 and a lower portion 40. The upper portion 10 defines a receiving chamber 11, opposite ends of which are open. The shield 20 and the lower portion 40 are respectively mounted at the openings of opposite ends of the receiving chamber 11. The circuit board 30 includes a plurality of light sources 31 and is arranged between the shield 20 and the lower portion 40. With the above structure and configuration, the shield 20 and the lower portion 40 are respectively mounted to the openings at opposite ends of the receiving chamber 11, forming a closed chamber to sufficiently protect the circuit board 30 and the light sources 31.

Referring to FIGS. 1-4, the shield 20 includes a cover 21, a decoration plate 22 and a light guide 23. The cover 21 is made of light-transmissive material and includes a plurality of light transmissive surfaces 211 such that the light emitted from the light sources 31 can pass through the cover 21 and then illuminate the decoration plate 22 or provide illumination. In the embodiment, the cover 21 is semi-transparent. The decoration plate 22 may be of a variety of shapes to increase the variety of products, and be more attractive to users. In the embodiment, the decoration plate 22 is in the form of a black circle, and the cover 21 is white. The light guide 23 is made of light-transmissive material and includes a plurality of light guiding portions corresponding to the light transmissive surfaces 211. The light sources 31 are arranged under the guiding portions of the light guide 23. When the light source 31 are turned on, light passes through the light guide 23 and the light transmissive surfaces 211 and travels to the decoration plate 22. Seen from the outside of the building block light module, the contrast is clearer, and the black part is brighter. When the building block light module is connected with another building block 50 to form a robot, the building block light module may serve as the eyes of the robot, which may be more attractive to users.

In the embodiment, the numbers of the light emitting plane 211 and the light source 31 are eight. The light transmissive surfaces 211 divide the cover 21 into eight equal portions. The light transmissive surfaces 211 are connected to one another and form cooperatively a slightly recessed surface with an opening in the center thereof. The recessed surface here is in a substantially cone shape. Two adjacent light transmissive surfaces 211 form a concave juncture therebetween and define an angle, such that when the adjacent light sources emit light of different colors, there is no light crosstalk between the light transmissive surfaces 211.

Referring to FIGS. 1-4, the cover 21 includes a mounting portion 213, and the decoration plate 22 is mounted to the mounting portion 213. In the embodiment, the decoration plate 22 includes a locking portion 221, and the mounting portion 213 defines a locking portion receiving portion 214. The locking portion 221 is engaged with the locking portion receiving portion 214. The locking portion 221 may be in the form of two tabs spaced from each other and each tab has a hook at an end thereof. The locking portion receiving portion 214 may be in the form of two slots. The two tabs are snap-fitted into the two slots to prevent the relative rotation between the decoration plate 22 and the cover 21. When the decoration plate 22 is assembled with the cover 21, the decoration plate 22 is directly pressed on the mounting portion 213 with the locking portion 221 engaged with the locking portion receiving portion 214. No screws or glues are needed to connect the cover 21 with the decoration plate 22, which is more convenient for assembling, thereby saving the manufacturing cost. In addition, when the locking portion 221 is properly pressed, it can be detached from the locking portion receiving portion 214 such that the decoration plate 22 of different shapes can be replaced, which facilitates maintenance of the product.

Referring to FIGS. 1-4, the cover 21 includes two protrusions 212 which are arranged uniformly on the periphery thereof. One end of the receiving chamber 11 includes an inward projecting portion 13. Two sliding grooves 12 are defined in the inner side surface of the receiving chamber 11. The two protrusions 212 are received in the sliding grooves 12 and contact the inward projecting portion 13. With the above structure and configuration, not only the cover 21 can be firmly fixed to the upper portion 10, but also the relative rotation between the shield 20 and the upper portion 10 can be avoided, which improves the service life of the lighting module.

Referring to FIGS. 1-5, in the embodiment, the decoration plate 22 is mounted at the center of the cover 21 so that light from each light source 31 can more uniformly illuminate the decoration plate 22, thereby forming an ideal light distribution on the decoration plate 22.

In the embodiment, the light guide 23 includes a top plate that has a shape similar to the cover 21 and a circular wall extending from the bottom surface of the top plate away from the cover 21. The light guide 23 and the cover 21 are separately formed and can be connected to each other by any suitable connection means, such as a lock and lock receiving hole that are formed and arranged similar to the locking portion 221 and locking portion receiving portion 214. It should be noted that the light guide 23 and the cover 21 may be integrally formed.

Referring to FIGS. 1-5, the circuit board 30 is a PCB on both sides of which include a signal port 32 for transmit signals for controlling the light sources. The upper portion 10 defines an opening 15 in the cylindrical side surface thereof. One end of the signal port 32 is received in the opening 15. With the above structure and configuration, it facilitates the signal connection between the building block light module and the external circuit, and the control of the LEDs 31 through an external main circuit.

Referring to FIGS. 1-5, the light sources 31 are light emitting diodes (LEDs), and the color of each LED may be the same or different. In the embodiment, the LEDs are RGB LEDs, and each LED can be controlled by the circuit board 30. Each LED 31 can emit seven colors: red, green, blue, red, green, red, blue, green, blue and white. In addition, the brightness of various colors of the LEDs can be controlled by adjusting the current, which can bring about a variety of color changes. In addition, the order of turning on the LEDs can be adjusted to cause the eight LEDs to form a variety of light effects. In the embodiment, the light sources 31 are disposed on the circuit board 30 in a circular array. In order to improve the light emitting effect of the building block light module, each of the light sources 31 can be independently controlled so as to facilitate detection of each light source 31. Through the cooperation of the light sources 31, a variety of luminous effects can be achieved for a better user experience.

Referring to FIGS. 1-6, the lower portion 40 includes a cover body 41 and a shielding plate 42. The cover body 41 includes a plurality of hooks 411, and the upper portion 10 defines a plurality of orifices 14 arranged corresponding to the hooks 411. When the lower portion 40 is mounted at the other end of the receiving chamber 11, the hooks 411 are snap-engaged with the orifices 14, and the shielding plate 42 is attached to the cover body 41, which avoids the relative rotation between the lower portion 40 and the upper portion 10, and enables the lower portion 40 to be securely connected to the upper portion 10.

Referring to FIGS. 1-6, in the embodiment, the lower portion 40 further defines a plurality of connection elements 413 through which the building block light module can connect with another building block 50, thereby forming a variety of functional effects, especially when the lighting module assembles with a building block robot, which can improve the playability of the building block robot, thereby improving the user experience. In the embodiment, the connection elements 413 are connection holes.

Referring to FIGS. 1-6, the shielding plate 42 includes a plurality of projections 421 and defines a plurality of recesses 422. The lower portion 40 defines a plurality of dents 412 for receiving the projections 421. The recesses 422 allow the hooks 411 to extend therethrough. The circuit board 30 is arranged above the shielding plate 42. With the above structure and configuration, not only the sealing property of the receiving chamber 11 is further improved, the PCB 30 is arranged in the receiving chamber 11, and the light leakage can be prevented, which improves the light energy utilization rate of the LEDs 31.

In view of the above, since the upper portion 10 and the lower portion 40, as well as the cover 21 and the decoration plate 22 are engaged with each other so that the overall structure of the building block light module becomes more compact. The PCB 30 includes a signal port 32 and the lower portion 40 defines a plurality of connection elements 413 so as to facilitate connection of the building block light module with other building blocks 50, which facilitates control of the lighting effect of the lighting module by an external circuit so as to improve the user experience.

Although the features and elements of the present disclosure are described as embodiments in particular combinations, each feature or element can be used alone or in other various combinations within the principles of the present disclosure to the full extent indicated by the broad general meaning of the terms in which the appended claims are expressed.

What is claimed is:

1. A building block light module comprising:

an upper portion defining a receiving chamber with two opposite open ends;

a shield attached to one of the open ends, and comprising a plurality of light transmissive surfaces;

a circuit board comprising a plurality of light sources corresponding to the light transmissive surfaces; and a lower portion defining a plurality of connection elements for mating with building blocks, and the lower portion and the shield being respectively mounted at the open ends of the receiving chamber.

2. The building block light module according to claim 1, wherein the shield comprises a decoration plate and a cover, the cover comprises a mounting portion, and the decoration plate is mounted to the mounting portion.

3. The building block light module according to claim 2, wherein the decoration plate comprises a locking portion, the mounting portion defines a locking portion receiving portion, and the locking portion is engaged with the locking portion receiving portion.

4. The building block light module according to claim 2, wherein the decoration plate is circular, and is mounted at a center of the cover.

5. The building block light module according to claim 2, wherein the cover comprises a plurality of light transmissive surfaces angled with each other and corporately forming a substantially cone shape, the decoration plate is mounted at a smaller end of the substantially cone shape.

6. The building block light module according to claim 1, wherein the number of the light transmissive surfaces is eight, and the light transmissive surfaces are evenly arranged at the shield.

7. The building block light module according to claim 6, wherein the cover is made of light-transmitting material.

8. The building block light module according to claim 1, wherein the light sources are light emitting diodes (LEDs).

9. The building block light module according to claim 8, wherein the LEDs are RGB LEDs.

10. The building block light module according to claim 1, wherein circuit board comprises a signal port to transmit signals for controlling the light sources.

11. The building block light module according to claim 1, wherein the lower portion comprises a cover body and a shielding plate connected to the cover body, and the shielding plate is arranged below the circuit board.

* * * * *